US005640979A

United States Patent [19]

Trenary

[11] Patent Number: 5,640,979

[45] Date of Patent: Jun. 24, 1997

[54] FINGER NAIL CLEANER ASSEMBLY WITH A ROTATING BRUSH

[76] Inventor: Don C. Trenary, 19650 SW. 207 Ave., Miami, Fla. 33186

[21] Appl. No.: 577,212

[22] Filed: Dec. 22, 1995

[51] Int. Cl.[6] ..... A45D 29/05

[52] U.S. Cl. ..... 132/73.6; 132/73; 132/76.5; 132/75.8; 132/75; 15/23

[58] Field of Search ..... 132/73, 73.5, 73.6, 132/75.3, 74.5, 75.8, 76.4, 76.5, 285; 433/118; 15/21.1, 22.1, 23, 28

[56] References Cited

U.S. PATENT DOCUMENTS

| | | | |
|---|---|---|---|
| 1,927,566 | 9/1933 | Hawk | 15/23 |
| 3,370,214 | 2/1968 | Aymar | 15/22.1 |
| 3,925,841 | 12/1975 | Caliendo | 15/23 |
| 4,683,897 | 8/1987 | McBride | 132/73.6 |
| 4,854,334 | 8/1989 | Su | 132/73.6 |
| 5,033,485 | 7/1991 | Hauerwas et al. | 132/73.6 |
| 5,289,604 | 3/1994 | Kressner | 15/22.1 |
| 5,504,961 | 4/1996 | Yang | 433/118 |

*Primary Examiner*—Gene Mancene
*Assistant Examiner*—Pedro Philogene

[57] ABSTRACT

A fingernail cleaner assembly with a rotating brush comprising: a brush assembly including an outer housing, a button, a motor and a rotating brush; the outer housing having an essentially hollow interior with a lower region and an upper region, the lower region including battery terminals and a removable battery cover, the upper region being formed in a generally conical configuration with a rounded apex, the apex including a concave slot positioned therein; and the motor including a rotating device and a drive rod and being electrically coupled to the battery and button, the drive rod extending into the concave slot of the apex of the outer housing, the drive rod having an upper extent including a beveled gear head with gear teeth, the rotating brush including a central gear with gear teeth, the central gear including a plurality of bristles and rotatably coupled within the slot of the outer housing, the gear teeth of the central gear being meshed with the gear teeth of the beveled gear head.

4 Claims, 3 Drawing Sheets

FINGER NAIL CLEANER ASSEMBLY WITH A ROTATING BRUSH

BACKGROUND OF THE INVENTION

1. Field of the Invention

The present invention relates to a fingernail cleaner assembly with a rotating brush and more particularly pertains to applying the rotating brush beneath the finger nail of a user to remove dirt and other debris.

2. Description of the Prior Art

The use of finger nail cleaning devices is known in the prior art. More specifically, finger nail cleaning devices heretofore devised and utilized for the purpose of cleaning the finger nails of a user by utilizing the devices in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,123,816 to Lupo a finger nail cleaning apparatus.

U.S. Pat. No. 4,180,884 to Hess discloses a finger nail cleaning apparatus.

U.S. Pat. No. Des. 289,345 to Fine discloses a finger nail cleaner brush.

U.S. Pat. No. 4,742,836 to Buehler discloses a finger nail cleaning device.

U.S. Pat. No. 4,137,929 to Grossman discloses a finger nail cleaner.

U.S. Pat. No. 4,020,856 to Masterson discloses a finger nail and hand cleaning appliance.

In this respect, the fingernail cleaner assembly with a rotating brush according to the present invention substantially departs from the conventional concepts and designs of the prior art, and in doing so provides an apparatus primarily developed for the purpose of applying the rotating brush beneath the finger nail of a user to remove dirt and other debris.

Therefore, it can be appreciated that there exists a continuing need for a new and improved fingernail cleaner assembly with a rotating brush which can be used for applying the rotating brush beneath the finger nail of a user to remove dirt and other debris. In this regard, the present invention substantially fulfills this need.

SUMMARY OF THE INVENTION

In view of the foregoing disadvantages inherent in the known types of finger nail cleaning devices now present in the prior art, the present invention provides an improved fingernail cleaner assembly with a rotating brush. As such, the general purpose of the present invention, which will be described subsequently in greater detail, is to provide a new and improved fingernail cleaner assembly with a rotating brush and method which has all the advantages of the prior art and none of the disadvantages.

To attain this, the present invention essentially comprises a new and improved fingernail cleaner assembly with a rotating brush comprising, in combination: a brush assembly including an outer housing, a button, a motor and a rotating brush; the outer housing being formed of first and second semicylindrical halves, the first and second halves being coupled together by a plurality of screws in an operative orientation, each half having a concave interior and including a lower region, an upper region and a central region therebetween, the first half including a circular aperture extending through the upper region and a removable battery cover in the lower region, the lower region of the second half of the outer housing having an upper extent and a lower extent each including battery terminals, two batteries being coupled between the terminals in an operative orientation, the central and lower regions of each half having linear edges, the upper region of each half being formed in a generally semiconical configuration with forwardly angled side edges and a rounded apex, each apex including a concave slot positioned therein, the concave slot of the second half having an axial aperture extending therethrough; a button and cooperatively coupled mounting plate, the button adapted to be positioned through the circular aperture with the mounting plate coupled to the inner surface of the first half, the button being operatively coupled to the battery with an electrical wire; the motor including a drive rod extending therefrom, the motor having rotating means and being operatively coupled to the battery and button with electrical wires, the button being depressed to activate the motor, the drive rod extending through the axial aperture in the concave slot of the apex of the second half, the drive rod having an upper extent including a beveled gear head with a plurality of gear teeth; the rotating brush including a central gear with a plurality of gear teeth, the central gear including an axial hole and a periphery with a plurality of bristles extending therefrom, an axle being radially positioned between the apexes of the first and second halves, the central gear being rotatably coupled around the axle, the gear teeth of the central gear being meshed with the gear teeth of the beveled gear head, in an operative orientation a user activating the device by depressing the button thereby causing the drive rod and gear head to rotate, the gear head causing the brush to rotate, the brush then being positioned under a user's finger nail to permit removal of dirt and other materials, a clear plastic cover formed in a generally conical configuration with a closed upper end and an open lower end, the clear plastic cover adapted to be coupled over the upper region when storing the apparatus; and a base formed in an essentially solid cylindrical configuration with first and second compartments, the lower region of the outer housing being positionable within the first compartment, a cream container formed in a cylindrical configuration and including cleansing cream and a lid, the lid including a handle extending upwardly therefrom, the cream container being positionable within the second compartment of the base, the base having a lower surface with a plurality of elastomeric feet affixed thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fingernail cleaner assembly with a rotating brush which has all of the advantages of the prior art finger nail cleaning devices and none of the disadvantages.

It is another object of the present invention to provide a new and improved fingernail cleaner assembly with a rotating brush which may be easily and efficiently manufactured and marketed.

It is further object of the present invention to provide a new and improved fingernail cleaner assembly with a rotating brush which is of durable and reliable constructions.

An even further object of the present invention is to provide a new and improved fingernail cleaner assembly with a rotating brush which is susceptible of a low cost of manufacture with regard to both materials and labor, and which accordingly is then susceptible of low prices of sale to the consuming public, thereby making such fingernail cleaner assembly with a rotating brush economically available to the buying public.

Still yet another object of the present invention is to provide a new and improved fingernail cleaner assembly with a rotating brush which provides in the apparatuses and methods of the prior art some of the advantages thereof, while simultaneously overcoming some of the disadvantages normally associated therewith.

Still another object of the present invention is applying the rotating brush beneath the finger nail of a user to remove dirt and other debris.

Lastly, it is an object of the present invention to provide a new and improved fingernail cleaner assembly with a rotating brush comprising: a brush assembly including an outer housing, a button, a motor and a rotating brush; the outer housing having an essentially hollow interior with a lower region and an upper region, the lower region including battery terminals and a removable battery cover, the upper region being formed in a generally conical configuration with a rounded apex, the apex including a concave slot positioned therein; and the motor including a rotating device and a drive rod and being electrically coupled to the battery and button, the drive rod extending into the concave slot of the apex of the outer housing, the drive rod having an upper extent including a beveled gear head with gear teeth, the rotating brush including a central gear with gear teeth, the central gear including a plurality of bristles and rotatably coupled within the slot of the outer housing, the gear teeth of the central gear being meshed with the gear teeth of the beveled gear head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
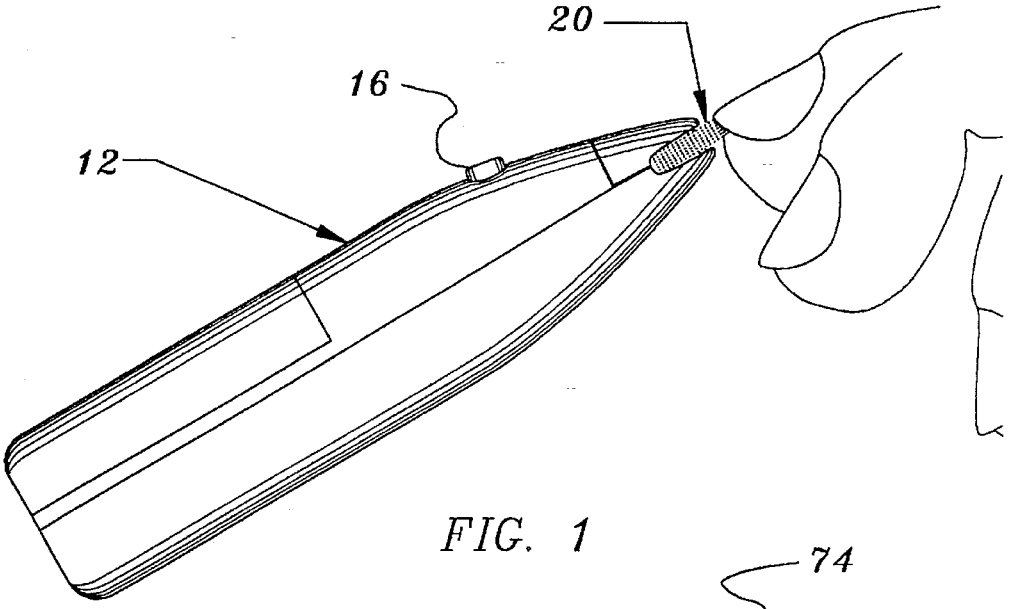
FIG. 1 is an isolated perspective view of the brush assembly illustrating the positioning of the rotatable brush in an operative orientation.

With reference now to the drawings, and in particular to FIG. 1 thereof, the preferred embodiment of the new and improved fingernail cleaner assembly with a rotating brush embodying the principles and concepts of the present invention and generally designated by the reference numeral 10 will be described.

The present invention, the fingernail cleaner assembly with a rotating brush 10 is comprised of a plurality of components. Such components in their broadest context include a brush assembly 12, an outer housing 14, a button 16, a motor 18, a rotating brush 20 and a base 22. Such components are individually configured and correlated with respect to each other so as to attain the desired objective.

More specifically, the brush assembly 12 includes an outer housing 14, a button 16, a motor 18 and a rotating brush 20. The brush assembly may be transported and stored by itself or within the base of the apparatus. The apparatus is available in a plurality of colors to satisfy the aesthetic desires of user. Note FIG. 1.

Figure 3:
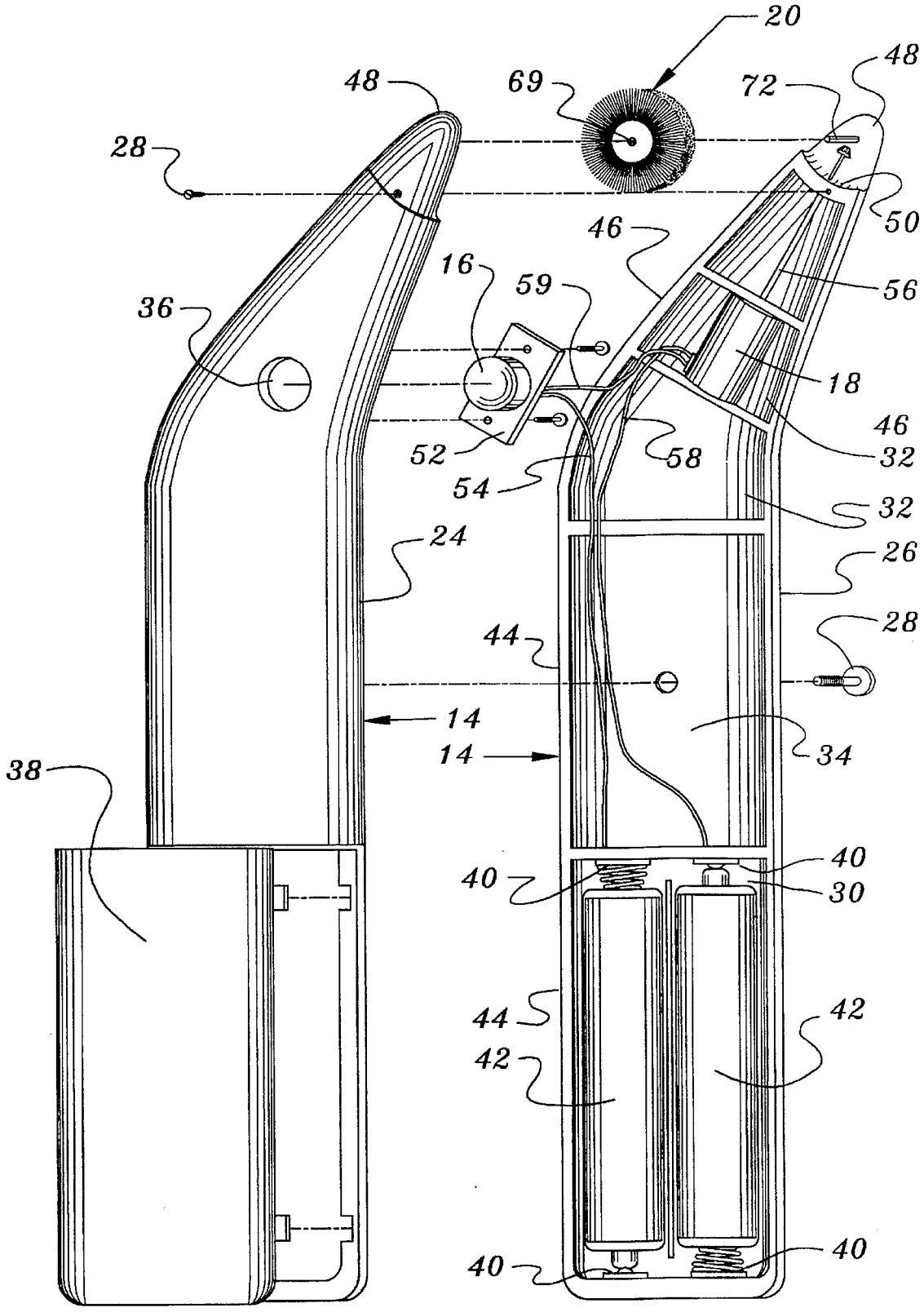
FIG. 3 is a separated perspective view of the apparatus illustrating the configuration of the first and second halves of the outer housing along with the other components of the brush assembly.

The outer housing 14 is formed of first 24 and second 26 semicylindrical halves. In the preferred embodiment the outer housing is fabricated of plastic. In an operative orientation the first and second halves are coupled together by a plurality of screws 28. This configuration permits easy changing of the brush and cleaning of the apparatus when necessary. Each half has a concave interior and includes a lower region 30, an upper region 32 and a central region 34 therebetween. The first half includes a circular aperture 36 which extends through the upper region to permit passage of the button of the apparatus. Note FIG. 3.

A removable battery cover 38 includes conventional snap tabs and is positioned in the lower region of the outer housing. The lower region of the second half of the outer housing has an upper extent and a lower extent. The upper and lower extents each include battery terminals 40. Two batteries 42 are coupled between the terminals in an operative orientation. In the preferred embodiment AA size batteries are utilized. The central and lower regions of each half have linear edges 44. The upper region of each half is formed in a generally semiconical configuration with forwardly angled side edges 46 and a rounded apex 48. The forwardly angled configuration provides a convenient angle for removal of dirt and other sentiments from a user's fingernails. Each apex includes a concave slot 50 positioned within it. The concave slot of the second half has an axial aperture extending through it. Note FIG. 3.

Figure 2:
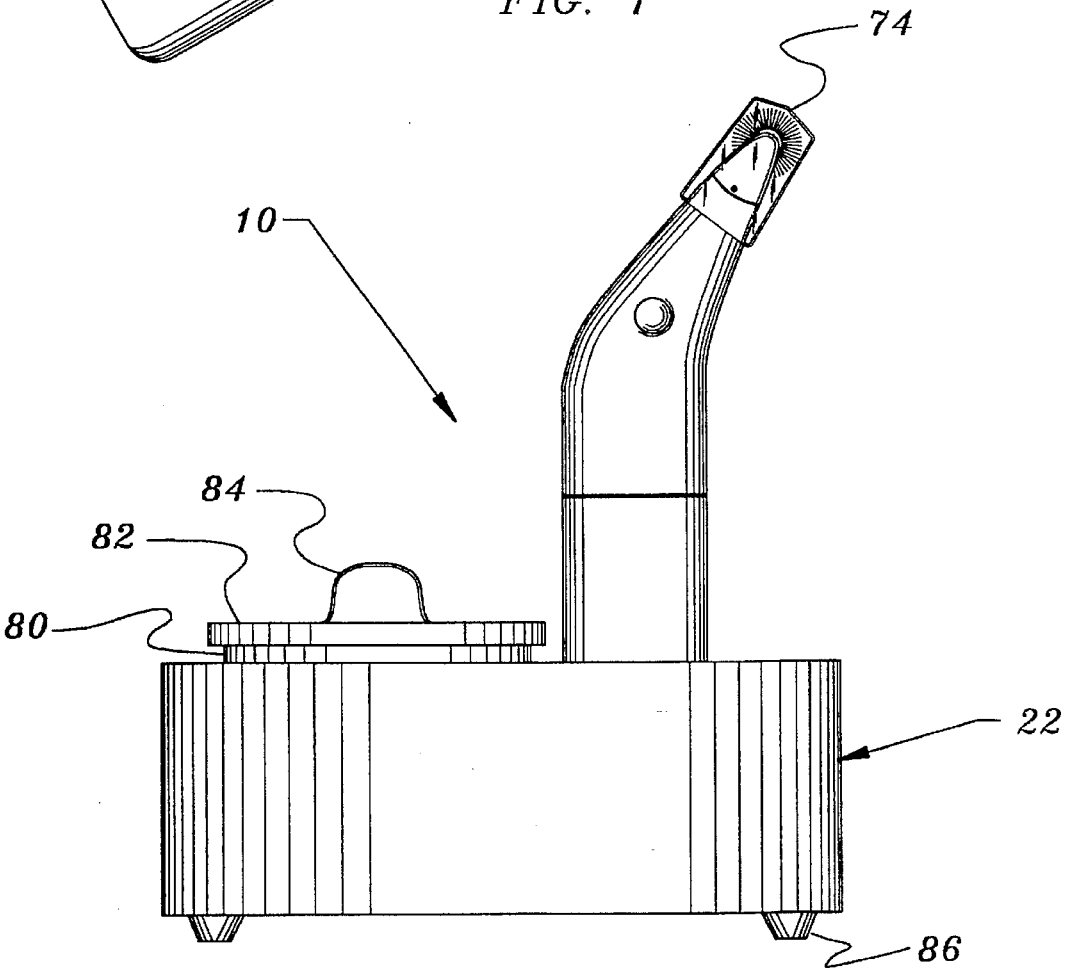
FIG. 2 is a perspective view of the preferred embodiment of the fingernail cleaner assembly with a rotating brush constructed in accordance with the principles of the present invention.

A button 16 and a cooperatively coupled mounting plate 52 are included with the apparatus. The button is adapted to be positioned through the circular aperture with the mounting plate coupled to the inner surface of the first half. The button is operatively coupled to the battery with an electrical wire 54. The button is positioned adjacent to the intersection of the upper and central regions of the outer housing. The button is easily accessible to a user's fingers at this location. Note FIGS. 2 and 3.

The motor 18 includes a drive rod 56 extending from it. The motor has rotating means and is operatively coupled to the battery and button with electrical wires 58, 59. The motor is positioned in the second half of the outer housing and adjacent to the button. The button is depressed by a user to activate the motor. The drive rod extends through the axial aperture in the concave slot of the apex of the second half. The drive rod has an upper extent which includes a beveled gear head 62 with a plurality of gear teeth 64. The beveled gear head is positioned between the apexes of the first and second halves of the outer housing. Note FIG. 3.

Figure 6:
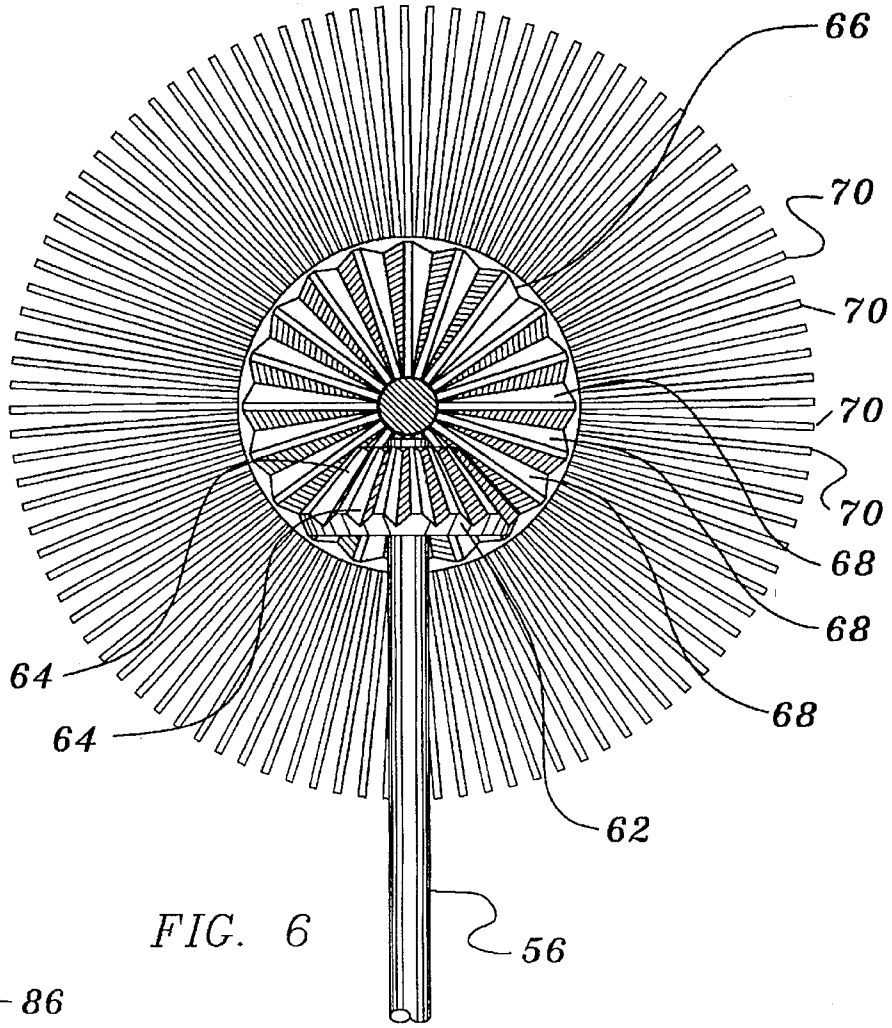
FIG. 6 is an isolated perspective view of the drive rod and rotating brush of the apparatus.

The rotating brush 20 includes a central gear 66 a plurality of gear teeth 68. The central gear includes an axial hole 69 and a periphery with a plurality of bristles 70 extending from it. An axle 72 is radially positioned between the apexes of the first and second halves. The central gear is rotatably coupled around the axle. The gear teeth of the central gear is meshed with the gear teeth of the beveled gear head. In an operative orientation a user activates the device by depressing the button thereby causing the drive rod and gear head to rotate. The gear head causes the brush to rotate. The brush is then positioned under a user's finger nail to permit removal of dirt and other materials. The cleansing cream of the apparatus is utilized in conjunction with the brush when the user's fingernails include grease or large quantities of dirt. Note FIGS. 1, 2 and 6.

Figure 4:
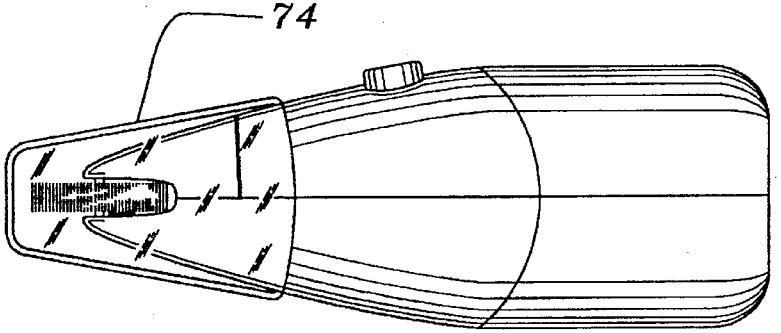
FIG. 4 is a top perspective view of the brush assembly with the clear plastic cover positioned over the brush and apex of the upper section of the outer housing.

A clear plastic cover 74 formed in a generally conical configuration with a closed upper end and an open lower end. The clear plastic cover is adapted to be coupled over the upper region when storing the apparatus. The cover protects the brush from dust and moisture. Note FIGS. 2 and 4.

Figure 5:
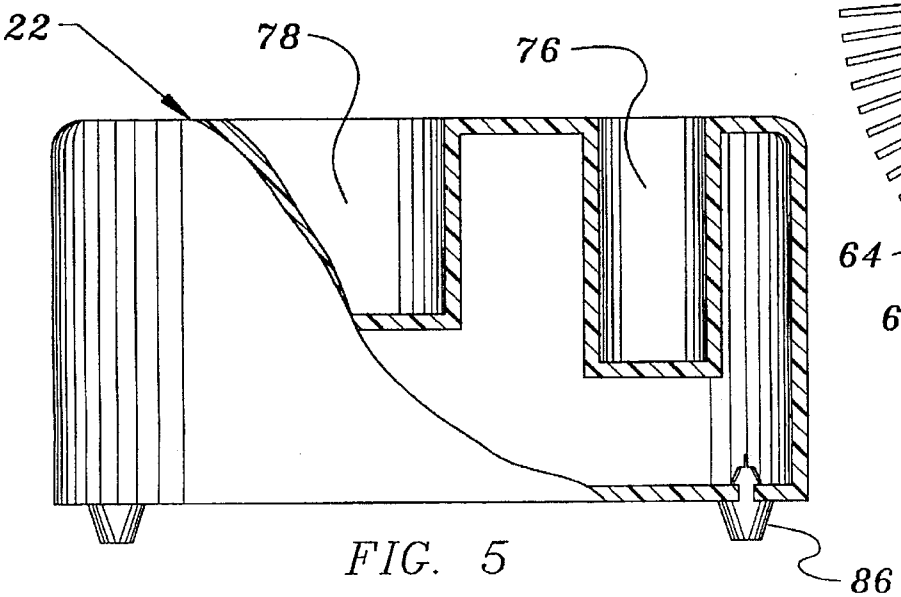
FIG. 5 is a partially broken away perspective view illustrating the first and second compartments of the base.

A base 22 is formed in an essentially solid cylindrical configuration with first 76 and second 78 compartments. The first compartment is between 25 and 50 percent the size of the second compartment. The lower region of the outer housing is positionable within the first compartment to permit upright storage of the outer housing. A cream container 80 is formed in a cylindrical configuration and includes cleansing cream and a lid 82. The lid includes a handle 84 extending upwardly from it. The cream container is positionable within the second compartment of the base. The base has a lower surface with a plurality of elastomeric feet 86 affixed to it to help prevent sliding of the base upon surfaces such as kitchen counter tops. Note FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved fingernail cleaner assembly with a rotating brush comprising, in combination:

a brush assembly including an outer housing, a button, a motor and a rotating brush; the outer housing being formed of first and second semicylindrical halves, the first and second halves being coupled together by a plurality of screws in an operative orientation, each half having a concave interior and including a lower region, an upper region and a central region therebetween, the first half including a circular aperture extending through the upper region and a removable battery cover in the lower region, the lower region of the second half of the outer housing having an upper extent and a lower extent each including battery terminals, two batteries being coupled between the terminals in an operative orientation, the central and lower regions of each half having linear edges, the upper region of each half being formed in a generally semiconical configuration with forwardly angled side edges and a rounded apex, each apex including a concave slot positioned therein, the concave slot of the second half having an axial aperture extending therethrough;

a button and cooperatively coupled mounting plate, the button adapted to be positioned through the circular aperture with the mounting plate coupled to the inner surface of the first half, the button being operatively coupled to the battery with an electrical wire;

the motor including a drive rod extending therefrom, the motor having rotating means and being operatively coupled to the battery and button with electrical wires, the button being depressed to activate the motor, the drive rod extending through the axial aperture in the concave slot of the apex of the second half, the drive rod having an upper extent including a beveled gear head with a plurality of gear teeth;

the rotating brush including a central gear with a plurality of gear teeth, the central gear including an axial hole and a periphery with a plurality of bristles extending therefrom, an axle being radially positioned between the apexes of the first and second halves, the central gear being rotatably coupled around the axle, the gear teeth of the central gear being meshed with the gear teeth of the beveled gear head, in an operative orientation a user activating the device by depressing the button thereby causing the drive rod and gear head to rotate, the gear head causing the brush to rotate, the brush then being positioned under a user's finger nail to permit removal of dirt and other materials, a clear plastic cover formed in a generally conical configuration with a closed upper end and an open lower end, the clear plastic cover adapted to be coupled over the upper region when storing the apparatus; and a base formed in an essentially solid cylindrical configuration with first and second compartments, the lower region of the outer housing being positionable within the first compartment, a cream container formed in a cylindrical configuration and including cleansing cream and a lid, the lid including a handle extending upwardly therefrom, the cream container being positionable within the second compartment of the base, the base having a lower surface with a plurality of elastomeric feet affixed thereto.

2. A fingernail cleaner assembly with a rotating brush comprising:

a brush assembly including an outer housing, a button, a motor and a rotating brush; the outer housing having an essentially hollow interior with a lower region and an upper region, the lower region including battery terminals and a removable battery cover, the upper region being formed in a generally conical configuration with forwardly angled side edges and a rounded apex, the apex including a concave slot positioned therein;

the motor including a rotating device and a drive rod and being electrically coupled to the battery and button, the drive rod extending into the concave slot of the apex of the outer housing, the drive rod having an upper extent including a beveled gear head with gear teeth, the rotating brush including a central gear with gear teeth, the central gear including a plurality of bristles and rotatably coupled within the slot of the outer housing, the gear teeth of the central gear being meshed with the gear teeth of the beveled gear head, in an operative orientation a user activating the device by depressing the button; and a clear plastic cover formed in a generally conical configuration with a closed upper end and an open lower end, the clear plastic cover adapted to be coupled over the upper region when storing the apparatus.

3. A fingernail cleaner assembly with a rotating brush comprising:

a brush assembly including an outer housing, a button, a motor and a rotating brush; the outer housing having an essentially hollow interior with a lower region and an upper region, the lower region including battery terminals and a removable battery cover, the upper region being formed in a generally conical configuration with a rounded apex, the apex including a concave slot positioned therein; and the motor including a rotating device and a drive rod and being electrically coupled to the battery and button, the drive rod extending into the concave slot of the apex of the outer housing, the drive rod having an upper extent including a beveled gear head with gear teeth, the rotating brush including a central gear with gear teeth, the central gear including a plurality of bristles and rotatably coupled within the slot of the outer housing, the gear teeth of the central gear being meshed with the gear teeth of the beveled gear head, in an operative orientation a user activating the device by depressing the button; and a base formed in an essentially solid cylindrical configuration with first and second compartments, the lower region of the outer housing being positionable within the first compartment.

4. The fingernail cleaner assembly with a rotating brush as set forth in claim 3 and further including:

a cream container formed in a cylindrical configuration and including cleansing cream and a lid, the lid including a handle extending upwardly therefrom, the cream container being positionable within the second compartment of the base, the base having a lower surface with a plurality of elastomeric feet affixed thereto.

* * * * *